US005526925A

United States Patent [19]

Bernstein

[11] Patent Number: 5,526,925

[45] Date of Patent: Jun. 18, 1996

[54] PAPERBOARD BOTTLE CARRIER WITH FOLDABLE HANDLE

[75] Inventor: Linda A. Bernstein, Campbell Hall, N.Y.

[73] Assignee: International Paper, Purchase, N.Y.

[21] Appl. No.: 355,189

[22] Filed: Dec. 8, 1994

[51] Int. Cl.[6] ..... B65D 75/00

[52] U.S. Cl. ..... 206/162; 206/141; 206/158; 294/87.2

[58] Field of Search ..... 294/87.2, 87.28; 206/141, 151, 158, 160–162, 199, 200, 147–149, 148, 163, 166, 170, 174

[56] References Cited

U.S. PATENT DOCUMENTS 2,252,235 8/1941 Snelling .
2,299,625 10/1942 Holmes .
2,375,467 5/1945 Chapman ..... 206/162
2,397,716 4/1946 Wendler ..... 206/148 X
2,650,128 8/1953 Failor ..... 294/87.28 X
3,073,644 1/1963 Baker et al. ..... 294/87.2
3,661,417 5/1972 Inman ..... 294/87.2
3,820,657 6/1974 Klygis et al. ..... 206/166
4,180,191 12/1979 Wood .

*Primary Examiner*—Bryon P. Gehman
*Attorney, Agent, or Firm*—Michael J. Doyle

[57] ABSTRACT

A bottle carrier is formed from a unitary paperboard blank, the carrier having a handle which is vertically disposed when manually carried and which is folded to or near a horizontal latched position for stacking and packing of multiple carriers. The handle has a finger receiving recess and a free, outer edge. The free edge is provided with curved recesses which releasably latch beneath the top caps or closures of the bottles. In its latched position, the handle does not inhibit stacking of the carriers. The construction requires less handle material than known carriers of its type.

6 Claims, 3 Drawing Sheets

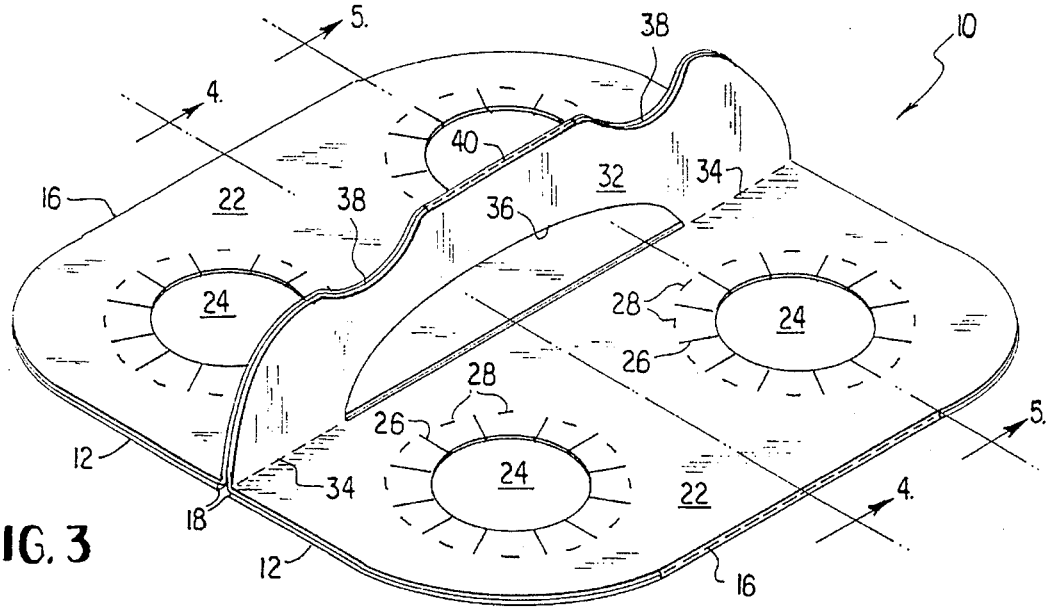
FIG. 3
FIG. 4
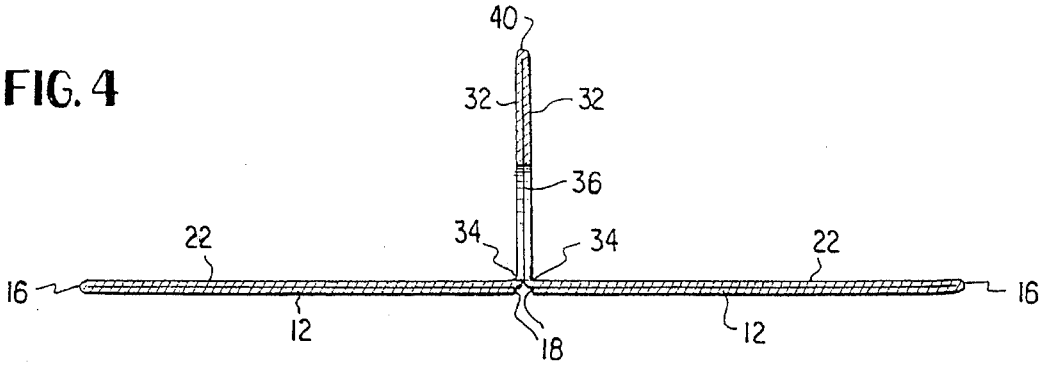
FIG. 5
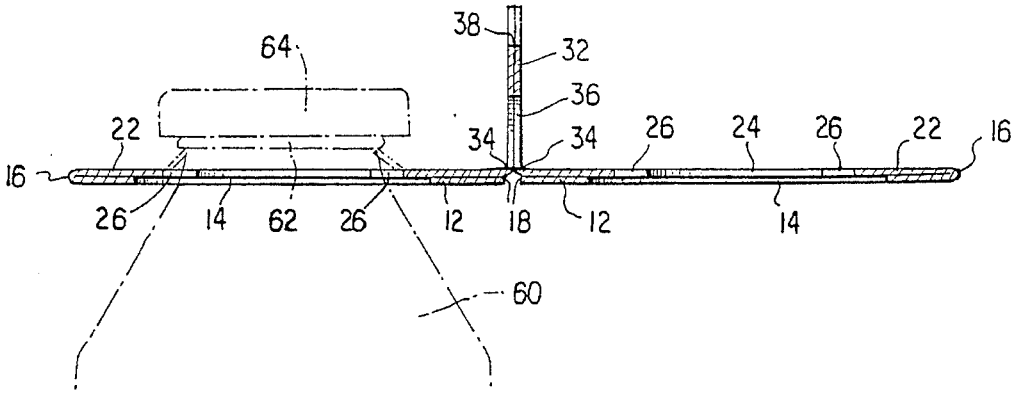

PAPERBOARD BOTTLE CARRIER WITH FOLDABLE HANDLE

BACKGROUND OF THE INVENTION

This invention relates to bottle carriers of the type fashioned from a unitary sheet of paperboard or other resilient, stiff, and bendable sheet material. Typical carriers of this type are shown in U.S. Pat. Nos. 2,252,235 issued to Snelling and 2,299,625 issued to Holmes. Such carriers are characterized by a vertical handle secured to a generally horizontal support platform or panels which have a plurality of openings therein for receiving glass bottles. The glass bottles are often of the type whose necks are each provided with an annularly continuous and integral bead, with a metal or other top closure cap located above the bead and serving to close the contents of the bottle. The openings of the support platform may be circular whose peripheries are provided with radially extending tongues defined by annularly spaced radial cuts, with each tongue having a depression or fold line at its base to facilitate upward bending. Upon insertion of a bottle into a respective opening, the radially innermost tips of the tongues engage beneath the integral bead to support the bottle therein, such an action shown in U.S. Pat. No. 5,323,895 issued to Sutherland.

The Snelling construction includes a handle of such a vertical extent that it can be folded to a horizontal position and thus not interfere with stacking or packaging of the carriers. Holmes overcomes the stacking problem due to the vertical handle by so relating the configuration of the bottle carrier handle and the bottles such that the handle may be bent from a vertical position to a substantially horizontal position, the handle releasably latching on the lower lip of a bottle closure or cap. This defines a temporary latching arrangement whereby individual units, such as of six bottles, may be vertically stacked or packaged yet which will enable a consumer to unlatch the handle of the topmost carrier of a stack and move the handle to a vertical position for carrying the bottles. While carrying out the intended function of a carrier with a handle which permits stacking, the construction of the noted Holmes patent suffers the drawback that the handle requires more material than is required even though requiring less handle material than the Snelling construction.

SUMMARY OF THE INVENTION

According to the practice of this invention, an improvement upon the Snelling and Holmes constructions is made which permits less handle material to be employed. This result is achieved by providing the free edge of the handle, namely, that edge of the handle most remote from the bottle support platform, with a pair of curved recesses. The relationship between the handle and the bottle receiving openings, and hence the bottle caps, is such that when the handle is folded from the vertical to one side or the other, it will engage beneath the skirt of the cap or other closure for the bottles, so as to hold the handle down to a substantially horizontal position and thus permit stacking of the carriers. The handle is of lesser vertical extent than that of either Snelling or Holmes and may be easily released from its latched position by the consumer who pulls up the handle to a vertical position for carrying.

BRIEF DESCRIPTION OF THE DRAWINGS

FIG. 3 is a perspective view illustrating the bottle carrier of this invention, with the handle in a vertical position and the support platform lying in a horizontal plane.

FIG. 4 is a view taken along Section 4—4 of FIG. 3.

FIG. 5 is a view taken along Section 5—5 of FIG. 3 and shows a bottle in phantom lines.

DETAILED DESCRIPTION OF THE INVENTION

Figure 1:
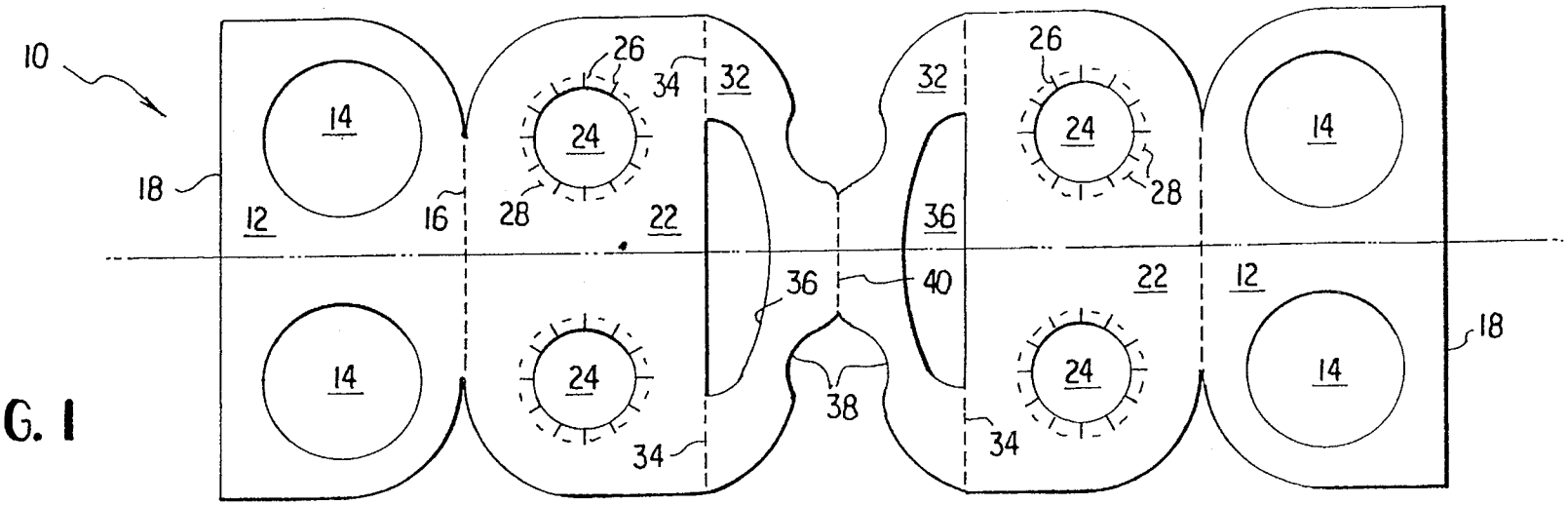
FIG. 1 is a plan view of a unitary blank of paperboard for forming the bottle carrier of this invention, according to a first embodiment.

Referring now to FIG. 1, the numeral 10 denotes generally a unitary paperboard blank of a first embodiment for forming the carrier of this invention. The blank includes the illustrated longitudinal axis and it will be observed that this axis is an axis of mirror symmetry. Further, directions at right angles to this axis will be referred to as transverse. The blank is of generally rectangular form and includes six serially joined panels in passing from left to right along the longitudinal axis. The first panel is denoted as 12 and includes two transversely spaced openings 14, panel 12 being joined to the next or second panel 22 by means of a transversely extending fold line 16. It will be seen that the left-hand edge of panel 12, designated as 18, is a free edge. The second panel 22 is provided with a pair of transversely spaced bottle receiving openings 24 whose peripheries include a plurality of radially extending tongues. Each tongue is defined by radially extending cut lines 26 and short cut or fold lines 28, the latter position at the base of each tongue. The right-hand edge of second panel 22 is foldably secured to a handle panel 32 by spaced fold lines 34 each of which is transversely extending relative to the noted longitudinal axis. The third or handle panel 32 is provided with a generally transversely extending finger opening 36, while a central portion of handle panel 32, at the extreme right thereof, is defined by a transversely extending fold line 40. The free edge of handle panel 32 is provided with a pair of curved recesses 38. The curvature of each recess 38 is such that there is a snap or interference fit between each recess and a respective bottle cap 64 and bead 62 when the handle is bent to the stacking position. It will be observed that fold line 40 defines an axis of mirror symmetrical reflection, in that if a mirror were placed perpendicular to the plane of the paper, and along fold line 40, what would be seen would be fourth, fifth and sixth panels, these latter three panels being to the right of fold line 40 in FIG. 1, and of the same shape and size as panels 32, 22, and 12.

Figure 2:
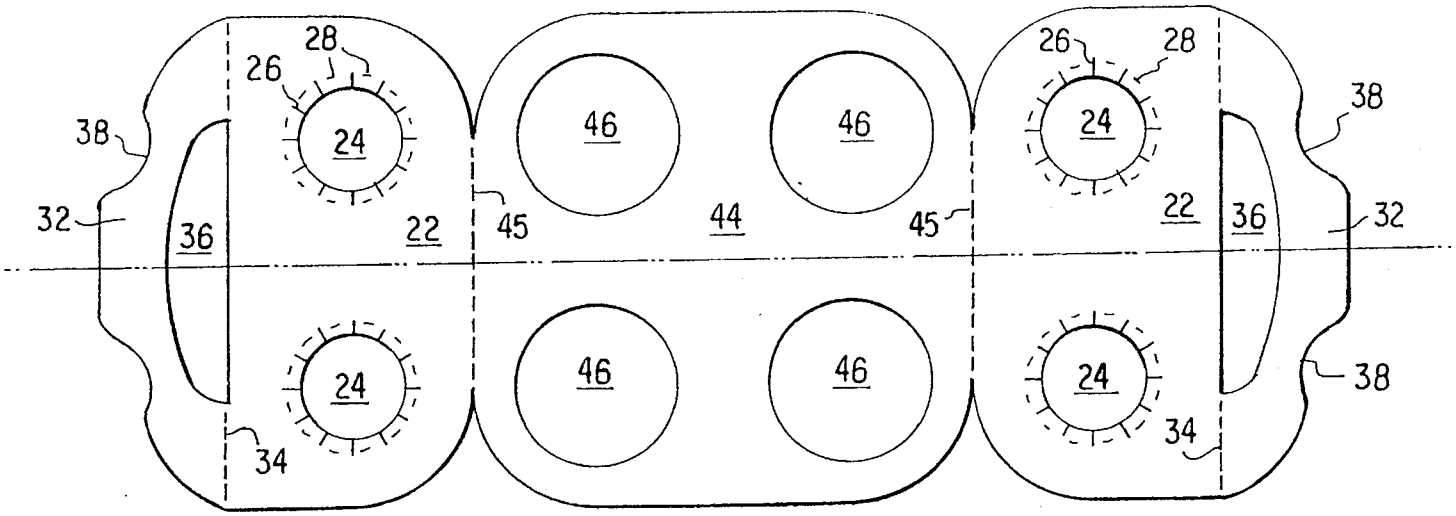
FIG. 2 is a plan view of a unitary blank of paperboard showing a second embodiment of the blank for forming the carrier of this invention.

Referring now to FIG. 2, another blank of generally rectangular form and defining a second blank embodiment is illustrated for producing the carrier of this invention. Here, the first panel along the indicated longitudinal axis is handle panel 32 having curved recesses 38 at its free or left edge. Again, handle panel 32 is provided with the same transversely extending finger receiving opening 36 as the embodiment of FIG. 1, with transversely spaced and transversely extending fold lines 34 joining handle panel 32 to second panel 22. The latter, as in FIG. 1, is provided with a pair of transversely spaced bottle receiving openings 24 of the same bottle neck and hand gripping construction as previously described. The right-hand edge of panel 22 terminates at a transversely extending fold line 45, to meet a third and central panel 44, the latter provided with four symmetrically placed openings 46. The right-hand portion of panel 44 is provided with another fold line 45, the latter connected to another panel 22 of the same construction as previously described, and the latter folded at transversely extending fold lines 34 to another handle panel 32 of the same construction previously described. It is seen that fold lines 45 each define an axis of mirror symmetrical reflection. If a mirror were placed perpendicular to the plane of the paper along the first fold line 45, the reflection of the first and second panels would be of the same configuration as that of the fourth and fifth panels.

Referring now to FIG. 3, the blank of FIG. 1 has been folded about central and transversely extending fold line 40, with handle panels 32 typically glued together in surface contact and with end panels 12 folded beneath respective panels 22 and glued thereto. It is seen that finger receiving recesses 36 of each of handle panels 32 coincide.

FIG. 4 shows the folding of end panels 12 beneath respective panels 22 and further illustrates handle panels 32 glued together and joined their upper edges by fold or hinge line 40.

FIG. 5 shows the carrier and further illustrates a glass bottle, shown in phantom lines, and denoted as 60. The glass bottle has an integral and annularly continuous bead 62 whose lower portion is engaged by the foldable tongues of a respective opening 24. Glass bottle 60 is provided with a metal or other closure top cap 64.

It will be observed that a carrier similar to that of FIG. 3 may be formed from the blank of FIG. 2 by folding panels 22 about respective fold lines 44 over the top of central panel 24 and then bending handle panels 32 vertically upwardly and gluing them together in surface contact. Typically, panels 22 are glued to panel 44.

It is seen that the combination of panels 12 and 22 for the blank of FIG. 1 and combination of panels 22 and 44 for the blank of FIG. 2 yields a horizontal support platform of double thickness.

Figure 6:
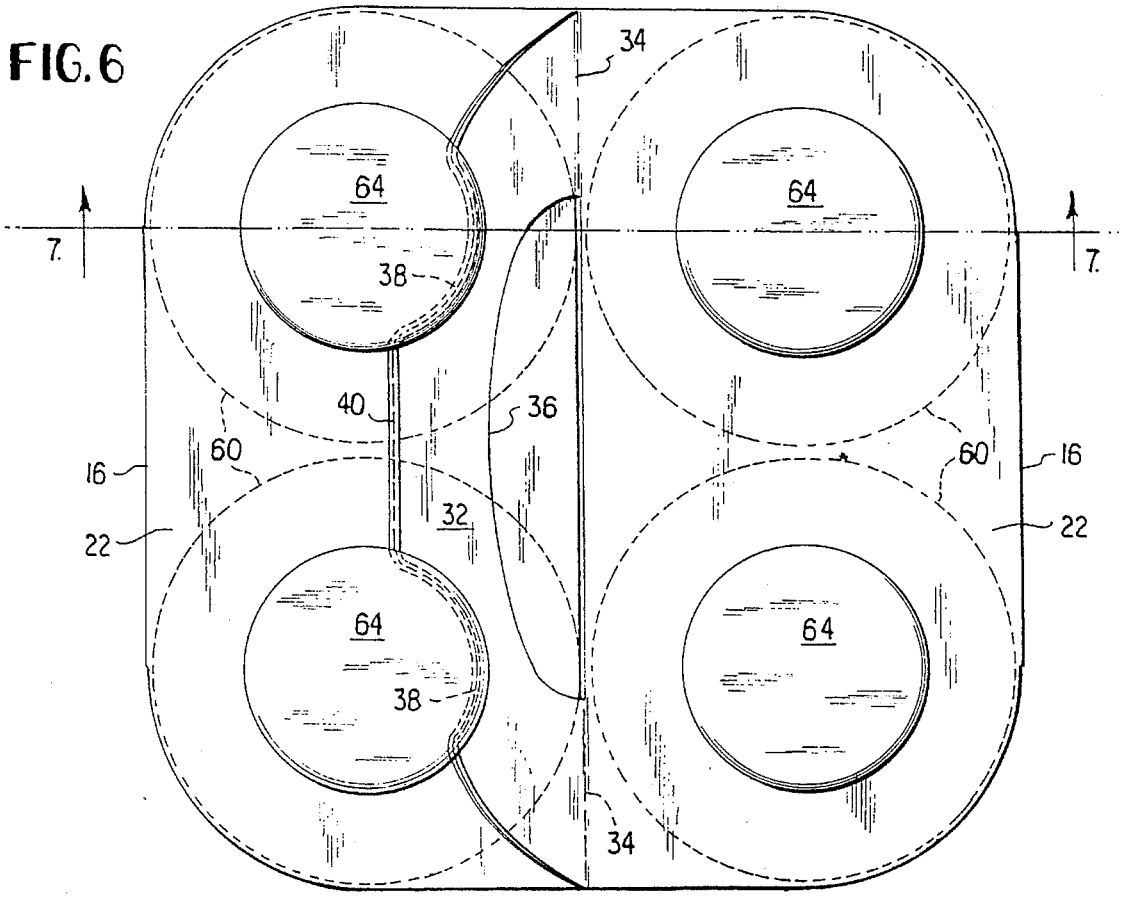
FIG. 6 is a top plan view showing the carrier with the handle in its temporarily latched position and showing the tops of several bottles in the carrier.
Figure 7:
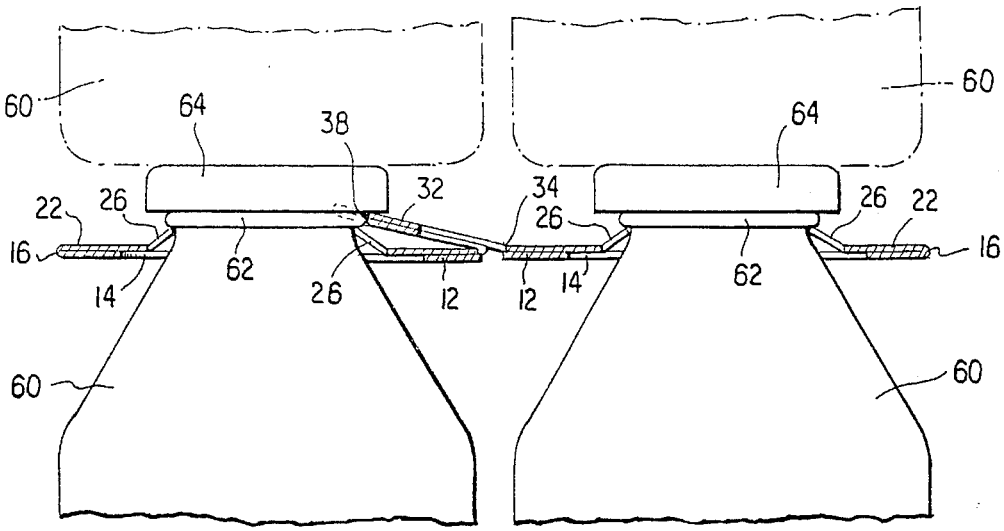
FIG. 7 is a view taken along Section 7—7 of FIG. 6.

Referring now to FIG. 6, each of the openings 24 of FIG. 3 has been filled with a bottle having a top cap closure 64, and double thickness handle 32 has been tilted to the left and releasably engages, along recesses 38 of the handle free edge, the undersides of nearest respective closure caps 64. This relation is also illustrated at FIG. 7 wherein the ends of tongues 26 are shown as engaging beneath respective beads 62 of bottles 60, with handle panels 32 engaged beneath bottle cap 64 such that free edge recesses 38 permit a snapping of the handle into the illustrated position shown at the solid lines. FIG. 7 also illustrates in phantom lines the bottoms of an upper group of carrier bottles stackably resting on caps 64 of the next lower group of carrier bottles 60.

The material saving advantage of this invention over the noted Holmes construction is easily seen. Namely, the finger opening in the handle is moved downwardly, this made possible by employing the free edge of the handle as a latching edge. The free edge of the Holmes carrier handle is not employed for a latching purpose. Recesses 38 along the handle free edge assure firm latching, stackability and easy handle release.

I claim:

1. A plural bottle carrier fashioned from a unitary blank of paperboard, the carrier having a handle and a support platform, said platform having a plurality of bottle neck receiving circular openings, each said opening adapted to receive a bottle neck having an integral bead therearound, said handle secured to said platform, said handle having two spread apart ends each foldably secured to said platform, said handle having a finger receiving opening located between said spaced apart ends, said handle having a free edge, said free edge having at least one curved recess having a circular arcuate portion, said handle being foldable from an upright position substantially perpendicular to said platform to a folded position more adjacent said platform in which folded position a portion of each said free edge curved recess is substantially tangent to one of said platform openings.

2. The bottle carrier of claim 1 wherein said handle is provided with two said curved recesses along said handle free edge, and wherein a portion of each of said two curved recesses is substantially tangent to a respective, corresponding platform bottle receiving opening.

3. A unitary paperboard blank for forming a bottle carrier, said blank being generally rectangular and including a plurality of longitudinally serially arranged panels, said blank having a longitudinal axis of mirror symmetry, a first panel at one longitudinal end of said blank, said first panel having a pair of openings transversely spaced from each other and on respective opposite sides of said longitudinal axis, said first panel foldably joined to a second panel about an axis at right angles to said longitudinal axis, said second panel having a pair of bottle neck receiving openings transversely spaced from each other and on respective opposite sides of said longitudinal axis, a third panel, said third panel being a handle panel and having two transversely spaced foldable connections to said second panel at right angles to and on opposite sides of said longitudinal axis, said handle panel having a generally transversely extending finger receiving opening located between its said two transversely spaced foldable connections, said handle panel being foldably connected at a central region thereof to a handle panel central transverse fold line intersected by said longitudinal axis, three additional panels commencing at said handle panel central transverse fold line, said three additional panels being in mirror symmetry to said first, second, and handle panels, said two handle panels each having a respective free edge portion each transversely spaced from said handle panel central transverse line, each said handle free edge portion having a curved recess, each said curved recess including a circular portion of substantially the same curvature as said second panel openings, the longitudinal distance along said longitudinal axis between each of said handle free edge curved recesses and said transversely spaced handle connections being substantially the same as the longitudinal distance along said longitudinal axis between said spaced handle connections and the nearest peripheral portions of said second panel bottle neck receiving openings.

4. A unitary paperboard blank for forming a bottle carrier, said blank being generally rectangular and including a plurality of longitudinally serially arranged panels, said blank having a longitudinal axis of mirror symmetry, a first handle panel at one longitudinal end of said blank, said first handle panel having a generally transversely extending finger opening, said first handle panel transversely foldably joined to a second panel by two transversely spaced foldable connections, said second panel having a pair of bottle neck receiving openings transversely spaced from each other, a third panel, said third panel having four bottle neck receiving openings, a fourth panel transversely foldably connected to said third panel, a fifth panel transversely foldably connected to said fourth panel by two transversely spaced fold lines, said fifth panel being a handle panel and having a generally transversely extending finger opening, said fourth and fifth panels together in mirror symmetry with said first and second panels, said first and fifth panels each having a free edge, each said free edge having a curved recess, each said curved recess including a circular portion of substantially the same curvature as said third panel openings, the longitudinal distance between each said curved recess of each said free edge and said transversely spaced handle connections being substantially the same as the longitudinal distance between said spaced handle connections and the nearest peripheral portion of said third panel bottle neck receiving openings.

5. A plural bottle carrier fashioned from a unitary blank of paperboard, the carrier having a handle and a support platform, said platform having a plurality of bottle neck receiving circular openings, each said opening receiving a bottle whose neck carries an integral bead therearound, each said bottle having a top closure cap, said handle having two spaced apart ends each individually foldably secured to said platform, said handle having a finger receiving opening located between said spaced apart ends, said handle having a free edge, said handle being folded to a position adjacent to said platform, a portion of said handle free edge engaging beneath a lower portion of some of said bottle top closure caps, said handle provided with two curved recesses along said handle free edge, said curve recesses being that said portion of said handle free edge engaging beneath a lower portion of at least some of said bottle top closure caps.

6. The bottle carrier of claim 5 wherein a portion of each of said two curved recesses is substantially tangent to a respective, corresponding platform opening.

* * * * *